US005083676A

United States Patent [19]

Hunter et al.

[11] Patent Number: 5,083,676

[45] Date of Patent: Jan. 28, 1992

[54] HAZARDOUS FLUID DISPENSER SAFETY SYSTEM HAVING A MERCURY TILT SWITCH

[76] Inventors: William D. Hunter, 307 Meyers St., Jackson, Mich. 49203; Hugh E. Cross, 440 Helen, Brooklyn, Mich. 49230

[21] Appl. No.: 509,608

[22] Filed: Apr. 16, 1990

[51] Int. Cl.[5] ..... B67D 5/08; B67D 5/14; G08B 21/00; H01H 35/02

[52] U.S. Cl. ..... 222/63; 340/689; 200/61.47; 200/61.52; 200/215; 200/223; 222/52

[58] Field of Search ..... 222/52, 54, 63; 200/61.45 R, 61.47, 61.52, 193, 194, 182, 183, 215, 216, 220, 223; 340/665, 686, 687, 689, 690

[56] References Cited

U.S. PATENT DOCUMENTS

| | | | |
|---|---|---|---|
| 1,611,594 | 12/1926 | Knutsson | 200/215 X |
| 1,612,424 | 12/1926 | Farr | 222/54 |
| 2,122,921 | 7/1938 | Sands | 200/61.47 |
| 2,311,808 | 2/1943 | Bacon | 200/215 |
| 2,537,490 | 1/1951 | Thompson | 200/223 |
| 2,782,276 | 2/1957 | Woods | 200/61.47 |
| 2,812,399 | 11/1957 | Schroeder | 200/61.47 |
| 2,840,272 | 6/1958 | Blackburn et al. | 222/63 X |
| 2,870,280 | 1/1959 | Kraus | 200/215 X |
| 3,335,246 | 8/1967 | Romanowski | 200/216 |
| 3,356,812 | 12/1967 | Moschetta et al. | 200/223 |
| 3,367,439 | 2/1968 | Zweben | 200/61.47 X |
| 4,305,058 | 12/1981 | Baumann | 200/223 X |
| 4,498,606 | 2/1985 | DiRienzo | 222/52 |
| 4,649,240 | 3/1987 | Davis, Sr. | 200/215 X |
| 4,661,663 | 4/1987 | Weinheimer | 200/61.47 X |

FOREIGN PATENT DOCUMENTS

| | | | |
|---|---|---|---|
| 7611 | 1/1979 | Japan | 222/63 |

*Primary Examiner*—Michael S. Huppert
*Assistant Examiner*—Kenneth DeRosa
*Attorney, Agent, or Firm*—Beaman & Beaman

[57] ABSTRACT

A system for dispensing hazardous fluid particular suitable for gasoline service stations utilizing an electrical impact sensing switch mounted upon each dispenser wherein the contacts of the normally open switch close upon impact occurring at the dispenser and the switch controls a primary electrical circuit energizing the pumps providing pressurized fluid to the dispenser whereby impact forces de-energizes the pumps minimizing to actuate alarms and alert personnel of the impact.

4 Claims, 2 Drawing Sheets

HAZARDOUS FLUID DISPENSER SAFETY SYSTEM HAVING A MERCURY TILT SWITCH

BACKGROUND OF THE INVENTION

The majority of gasoline sold at retail is through self service dispensers located on islands adjacent a building housing the attendant cashier. Necessarily, the dispensers, and the flexible hoses attach thereto, must be located adjacent vehicle lanes whereby the vehicle maybe located adjacent the dispenser during refueling.

Because of the close proximity of the dispenser to the vehicle lanes it is common for accidents to occur wherein a vehicle entering or leaving a lane accidentally strikes a dispenser. To minimize such accidents it is common to mount the dispensers upon raised concrete islands and inbed concrete and steel barriers in the islands adjacent the dispensers. However, while such protective barriers are effective in many instances, it is necessary to provide access to the dispensers, and the degree to which the dispenser can be protected is limited, and dispensers are often involved in accidents. Vehicles crossing the vehicle lane may strike a dispenser from the side, and thousands of accidents occur each year in the United States wherein a gasoline dispenser is struck by a vehicle and life threatening and property damaging fires often result.

While gasoline dispensers often utilize frangible fluid conduit connections to terminate gasoline flow in the event of dispenser impact or excessive tension on the outlet hose such conduit safety devices are not dependable as they will often corrode and become inoperative, and heretofore a dependable electrical safety system for gasoline dispenser systems and other hazardous fuel dispensing systems has not been available.

It is an object of the invention to provide a safety system for hazardous fuel dispenser systems such as occur in gasoline service stations wherein electrical impact sensing switches are associated with each dispenser to immediately sense dispenser movement and deactivate the supply of gasoline to the dispenser to minimize hazardous fluid loss.

Another object of the invention is to provide a hazardous fluid dispenser safety system employing electric supply pumps and dispensers wherein electrical impact sensing switches located at each dispenser are electrically connected to a central electrical supply system for a plurality of pumps wherein the entire pumping control circuit is deenergized upon dispenser impact occurring.

An additional object of the invention is to provide a hazardous fluid safety dispenser safety system utilizing an electrical impact safety sensing switch which may be readily mounted upon the conventional electrical circuit components used with gasoline dispensers.

A further object of the invention is to provide an electric impact sensing switch for use with hazardous fluid dispenser safety systems wherein liquid mercury is retained within a closed envelope selectively associating with electrical terminals whereby impact forces imposed upon a dispenser housing on which the switch is mounted will cause movement of the mercury to close the circuit between the contacts and the switch envelope is protected from impact and exterior forces. In the practice of the invention an impact sensing switch utilizing liquid mercury encapsulated within a protective environment is mounted upon a conventional electric circuit box within each dispenser of a gasoline service station, for instance. The terminals of the impact sensing switch are connected to a control unit associated with the emergency power cut off switch of the electrical power circuit supplying the pumps which provide gasoline to the dispensers. Preferably, this circuitry also controls all electricity to the lights and other electrical devices in the vicinity of the dispensing area.

Upon the circuit of any impact sensing switch closing the primary emergency cut off switch is activated to deenergize the gasoline supplying pumps and other circuits to the dispensing area, and the potential fire hazard is immediately controlled and minimized. The safety system of the invention can only be rearmed and reset by authorized personnel, and the system cannot be inadvertently deactivated by unauthorized personnel.

BRIEF DESCRIPTION OF THE DRAWINGS

The aforementioned objects and advantages of the invention will be appreciated from the following description and accompanying drawings wherein:

FIG. 1 is a schematic plan layout view of a typical gasoline service station installation utilizing the inventive concepts.

DESCRIPTION OF THE PREFERRED EMBODIMENT

Figure 8:
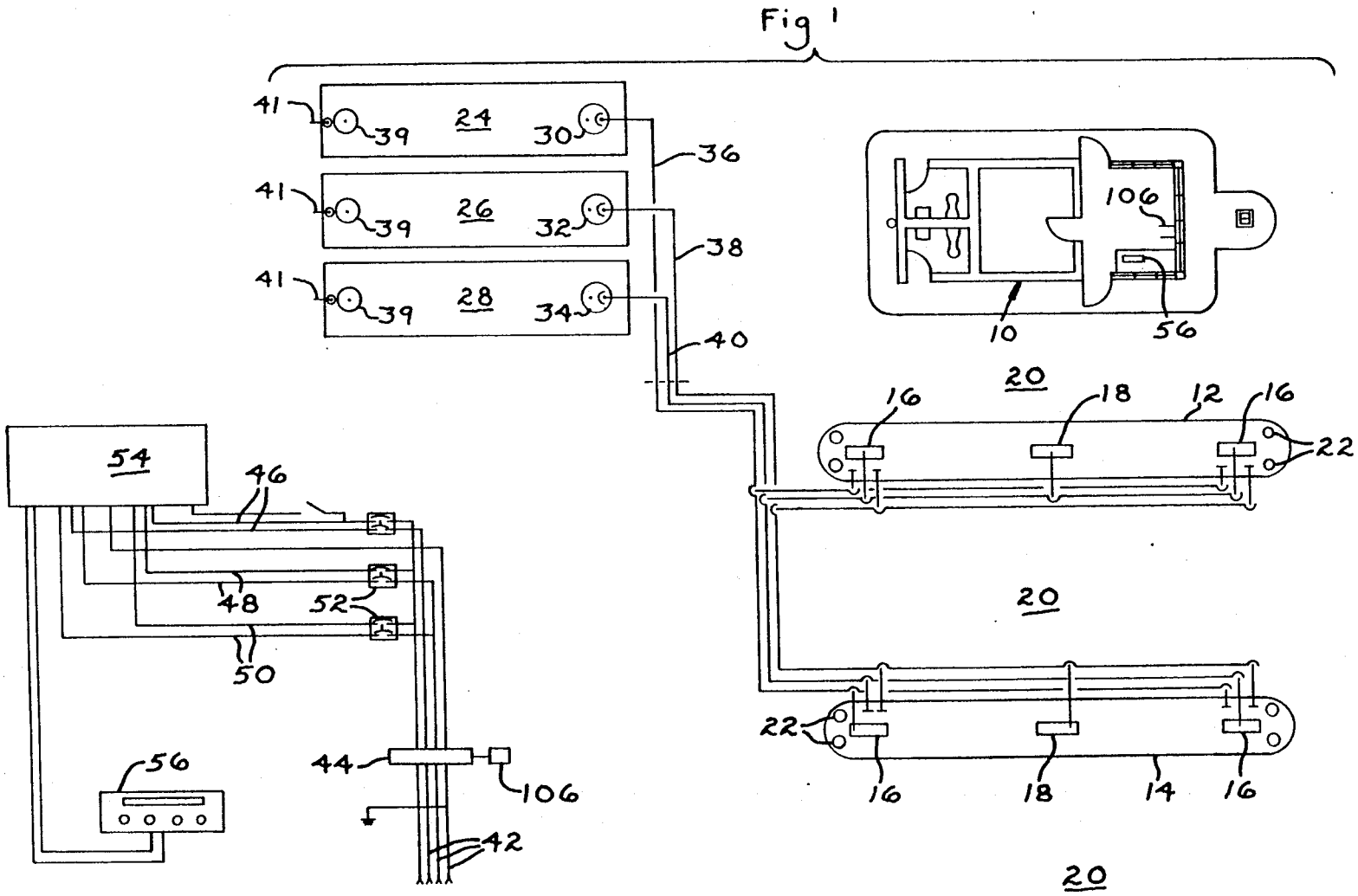
FIG. 8 is a typical schematic electrical circuit as employed with the service station arrangement shown in FIG. 1.

The hazardous fluid dispenser safety system of the invention can be used with any type of fluid dispensing system with which the safety aspects of the invention are desired. The invention finds its greatest usage with retail gasoline service stations selling automotive fuel products, and in FIG. 1 a typical gasoline service station layout utilizing the inventive concepts is illustrated.

The service station usually will include a building 10 which contains the usual cashier's counter, the dispensers, console, cash register, and the like, including restroom facilities. A pair of elongated raised concrete islands 12 and 14 are located adjacent the building 10, and a plurality of multifuel dispensers 16 are mounted upon the islands, and a single fuel dispenser 18 is centrally mounted on each island. An arrangement such as disclosed is typical.

Vehicle lanes 20 exist adjacent the islands 12 and 14 wherein the vehicles being refilled may stop adjacent the desired dispenser, as is well known. Usually, the islands include barriers, such as vertical columns 22 located adjacent the dispensers closest to the island ends for protecting the dispensers. Regardless, the dispensers 16 and 18 must be accessible to use by the customers and are sufficiently exposed as to be accidentally struck by erratic vehicular traffic.

The dispensers 16 and 18 are supplied from subterranean fuel tanks 24, 26 and 28, and submergeable pumps 30, 32 and 34 are located within each of the aforedescribed tanks, respectively, and the output of the pumps 30, 32 and 34 is connected to the conduits 36, 38 and 40, respectively, which communicate with the dispensers. Three conduits supply the dispensers 16 which are capable of handling three different types of fuel, such as regular unleaded, midgrade unleaded and premium unleaded, while the single fuel dispensers 18 are only supplied by the single tank 28. Each of the tanks is provided with an inlet 39 through which the tank may be filled, and each tank is also provided with a vent 41, as well known.

The pumps 30, 32 and 34 are electrically operated, as are the dispensers 16 and 18, and of course, assorted lights and other electrical accessories are mounted upon the islands 12 and 14, and the canopies, not shown, often superimposed over the islands. The electrical power required by the dispenser pumps, and required by the islands and associated areas, are supplied through electrical power lines 42, as shown in the circuit diagram of FIG. 8.

The entire electrical system of the service station, FIG. 8, is controlled by a primary emergency power cut off switch illustrated at 44, and the circuit through the switch 44 includes the conductors 46, 48 and 50 which supply the motors of the submergeable pumps 30, 32 and 34, respectively. The pump motor circuits are protected by fuses 52, and the pump motor circuits, and other circuits, are fed into the main junction box 54. The dispenser console 56 is connected to the junction box 54, and is usually located within the building 10 adjacent the cash register so that the attendant would be able to quickly determine how much gasoline is dispensed by each pump, and its cost. The console 56 includes the usual informational readout and associated controls.

Figure 2:
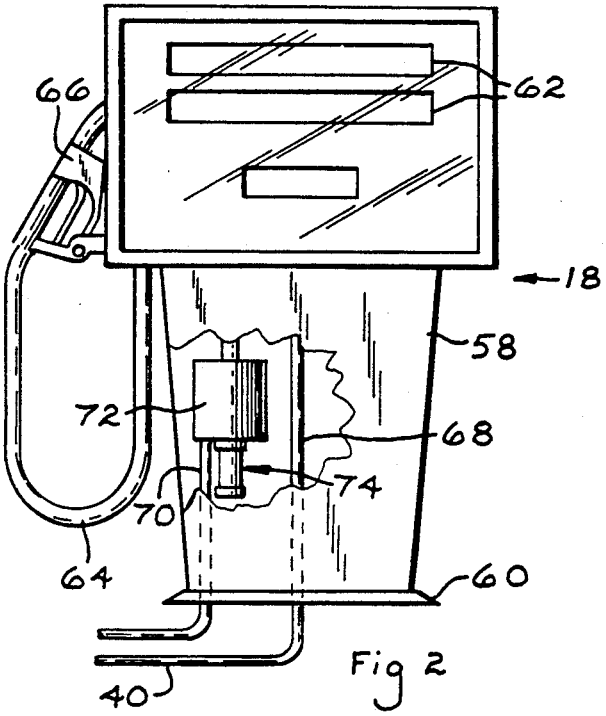
FIG. 2 is an elevational view of a typical gasoline dispenser, partially sectioned, utilizing the invention.

A typical dispenser of the gasoline type using the inventive concepts is shown in FIG. 2 wherein the dispenser 18 includes a cabinet 58, a base 60, and the usual displays 62 upon which the gasoline price, the amount pumped, and its cost is shown. The dispenser further includes a flexible outlet hose 64 terminating in the nozzle 66 which permits the purchaser to control the amount of gasoline pumped to refuel a vehicle, not shown.

The dispenser 18 is supplied by a subterranean conduit 40 connected to the submerged pump 34 located in tank 28. The conduit 40 is connected to the dispenser's vertical supply conduit 68 which is connected to the metering apparatus, not shown, in turn supplying the hose 64 as is well known.

Electricity to the dispenser 18 is through the subterranean electrical supply conduit 70 which is attached to a convential junction box 72 located within the dispenser cabinet 58, in the usual manner. The junction 72 includes the usual threaded ports or openings, and the impact switch assembly 74 is threaded into one of the lower junction box openings utilizing the junction box conventional threads.

Figure 3:
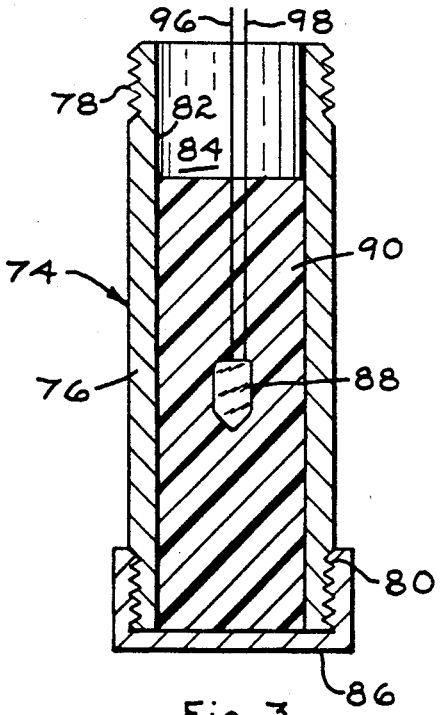
FIG. 3 is an elevational, diametrical sectional view of an impact sensing switch assembly in accord with the invention.

The impact switch assembly 74 includes a cylindrical tube 76, which may constitute a pipe nipple of four or six inch length. The tube 76, on its exterior surface, is provided with threads 78 at one end, and threads 80 at the other end. The tube 76 includes the bore 82 defining the tube cavity 84. The lower end of the tube 76 is closed by the conventional cap 86 threaded upon threads 80, as will be appreciated from FIG. 3.

Figure 4:
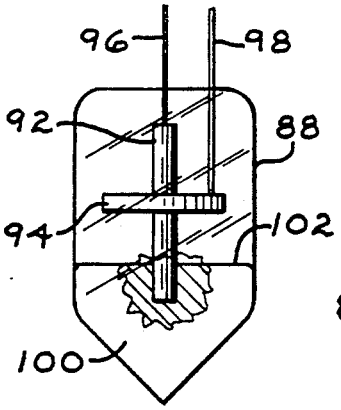
FIG. 4 is an elevational view of the mercury containing envelope illustrating the mercury in the normal switch open condition.

The switch terminals are enclosed within a hermetically sealed envelope 88 locate within the tube cavity 84 in radially spaced relationship to the wall of the bore 82, and the cavity 84 is substantially filled with a synthetic plastic epoxy 90, FIG. 4, which completely surrounds the envelope 88 and protects the envelope and its associated structure from damage.

Figure 5:
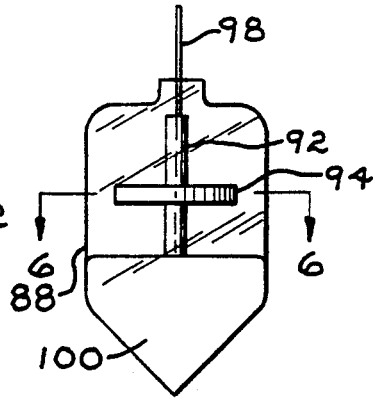
FIG. 5 is a side elevational view of the envelope of FIG. 4 as taken from the right thereof.
Figure 6:
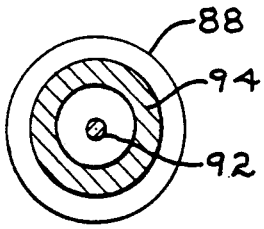
FIG. 6 is a plan sectional view of FIG. 5 as taken along Section 6—6.

The envelope 88 and its associated components is best illustrated in FIGS. 4 and 5. The envelope 88 is preferably formed of transparent glass of the configuration as will be apparent from FIGS. 4 and 5, and internally includes a central elongated terminal 92 located within the center of the envelope. A ring terminal 94 surrounds the terminal 92, and a conductor 96 is electrically connected to the terminal 92, while the conductor 98 connects to the ring terminal 94.

Figure 7:
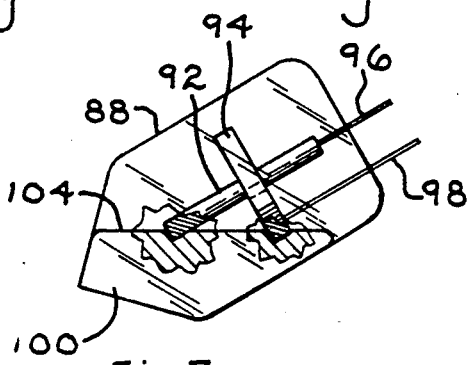
FIG. 7 is a side elevational view of the mercury envelope, similar to FIG. 4, illustrating the envelope in a tipped condition and the mercury closing the associated electrical terminals.

A pool of liquid mercury 100 is located at the lower region of the envelope 88, and the terminal 92 extends into the mercury pool as will be appreciated from FIG. 4. In its normal condition, when the tube 76 is vertically oriented, the upper surface of the mercury will be horizontally disposed as represented at 102. As will be appreciated from FIGS. 4 and 5, in its normal condition the mercury level 102 is substantially below the ring terminal 94. However, if the envelope 88 is tilted with respect to the vertical, for instance 45 or 50 degrees, as shown in FIG. 7, the upper surface of the mercury pool will be as shown at 104, and the mercury will engage both terminals 92 and 94 as illustrated, thereby closing the circuit between the terminals 92 and 94, and the conductors 96 and 98. As the terminal 92 is centrally located within the envelope 88, and as the ring terminal 94 is continuous throughout its periphery within the envelope, the switch assembly 74 in omni directional with respect to the direction of envelope tilt.

Figure 9:
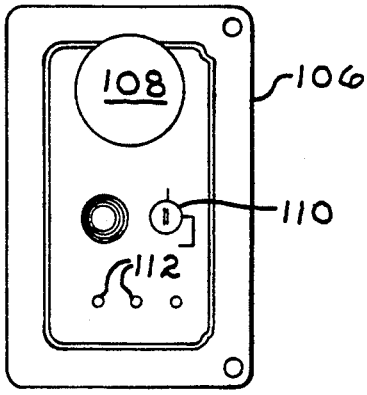
FIG. 9 is an elevational view of the control panel of the circuit box used with the safety system of the invention.

Each of the dispensers 16 and 18 includes an electric impact switch assembly 74, and the conductors 96 and 98 of each switch assembly are associated with the hazardous fluid dispenser safety system box 106, which is preferably located within the building 10 adjacent the attendant's station. The circuit box 106, on its cover, FIG. 9, includes an emergency stop button 108 of a large size and visible color, wherein pushing of the button 108, through appropriate circuits and wiring, will activate the emergency power cutoff switch 44 and degenerize the tank pumps 30, 32 and 34, and all of the circuitry supplied through the power lines 42. The safety system circuit box 106 also includes a key operated switch 110 rotatable to active and reset/override positions whereby the alarm system may be selectively armed or overridden for resetting, testing or other purposes. As the multipositional switch 110 is key operated only authorized personnel are able to position the switch 110, and hence, the safety features of the invention will not be inadvertently deactivated by unauthorized personnel. Pilot lights 112 located on the box 106 will indicate to an observer the condition of the safety system as to whether it is operative, armed, overridden, or if the alarm is being activated.

In use, the switch 110 will be in the active position and the pilot light 112 indicating such stat will be illuminated. The primary switch 44 will be closed, and the dispenser pumps, and electrical circuitry of the entire service station will be energized in the normal manner. Gasoline will be dispensed through the appropriate dispensers 16 and 18 upon demand, and as the switch assemblies 74 will be in their normal vertical open orientation, as shown in FIG. 4, the terminal 92 will be located within the mercury pool 100, but the ring terminal 94 would be out of contact with the pool.

In the event of impact forces engaging a dispenser 16 or 18 such impact need only be sufficient to cause an instantaneous movement of the mercury 100 to close the circuit between terminals 92 and 94. Such an impact may be a lateral force on a dispenser which does not cause the dispenser to tilt, but may cause a horizontal displacement. If the dispenser is tilted from the vertical the mercury pool 100 will also short the terminals 92 and 94 as shown in FIG. 7, and regardless of the nature of the impact, as long as the impact is sufficient to establish a momentary circuit between terminals 92 and 94 the circuitry of the safety system box 106 to which the conduits 96 and 98 are connected, will close actuating the emergency power cutoff switch 44 to which the circuit box 106 is operatively connected through electrical conductors. The particular circuitry of the safety system box 106 does not constitute an inventive aspect of the invention as a wide variety of circuits will be known to those skilled in the art to achieve the desired result.

Preferably, upon the circuit between conductors 96 and 98 of any dispenser being momentarily shorted, in addition to the cutoff switch 44 being operated to terminate electrical flow to the tank pumps, dispensers and dispensing area, both visual and audible alarms are energized, and if desired, security systems, police and fire departments may also be alerted if the control box 106 is also wired to operate such circuits.

After the problem has been corrected, authorized personnel with a key will operate the key switch 110 to reset the safety system and resume normal operation.

It will be appreciated that the practice of the invention provides an automatic shutoff of pressurized fuel to the dispensers in the event of impact forces being imposed upon a dispenser, and the practice of the invention substantially reduces the hazard of gasoline spills and ignition over previous safety systems.

It is appreciated that various modifications to the inventive concepts may be apparent to those skilled in the art without departing from the spirit and scope of the invention.

What is claimed is:

1. A hazardous fluid dispensing system comprising, in combination, a plurality of fluid dispensers each including a supply and discharge conduit, a plurality of electric pumps supplying fluid under pressure to selective pumps' supply conduit, an electric control circuit controlling energization of said pumps, an electric impact sensing switch mounted on each of said dispensers connected to said control circuit whereby impact forces imposed on any of said dispensers are sensed by the associated switch to operate said control circuit to deenergize said pumps, said electric impact sensing switch comprising a closed liquid tight envelope, a pair of spaced electric terminals within said envelope, a mass of liquid mercury within said envelope having a normal orientation within said envelope to the vertical and selectively producing an electrical connection between said terminals, said envelope being of such configuration and said terminals being so located therein that said liquid mercury and terminals will produce an electrical signal upon a dispenser and associated switch being disoriented to the vertical a predetermined extent or upon a predetermined force lateral to the vertical being imposed upon a dispenser and associated switch.

2. In a hazardous fluid dispensing system as in claim 1, said impact sensing switch including a hollow body defining a cavity having upper and lower regions, said envelope being located within said body intermediate said regions, and an encapsulating material within said body cavity surrounding said envelope to protect said envelope.

3. In a hazardous fluid dispensing system as in claim 2, said body comprising a cylindrical tube, and threads defined on the exterior of said tube adjacent an end region whereby said tube may be threadedly connected to an electrical circuit box.

4. In a hazardous fluid dispensing system as in claim 3, said tube comprising a pipe nipple having threads at each end region, and a cap threadedly connected to and enclosing one end region of said nipple.

* * * * *